US007637130B2

(12) United States Patent
Carr

(10) Patent No.: US 7,637,130 B2
(45) Date of Patent: Dec. 29, 2009

(54) LOCKDOWN DOOR BAR

(76) Inventor: Ronald R. Carr, 4232 Voice Rd., Kingsley, MI (US) 49649

( * ) Notice: Subject to any disclaimer, the term of this patent is extended or adjusted under 35 U.S.C. 154(b) by 85 days.

(21) Appl. No.: 11/874,038

(22) Filed: Oct. 17, 2007

(65) Prior Publication Data

US 2009/0100884 A1 Apr. 23, 2009

(51) Int. Cl.
*E05B 73/00* (2006.01)

(52) U.S. Cl. ..... 70/14; 70/416; 70/232; 292/259 R; 292/288; 292/289

(58) Field of Classification Search ..... 70/14, 70/18, 16, 212, 232, 416; 292/259 R, 288, 292/289, 290, 292
See application file for complete search history.

(56) References Cited

U.S. PATENT DOCUMENTS 3,545,237 A * 12/1970 Gardella, Jr. et al. ..... 70/16
3,819,216 A 6/1974 Richardson
3,980,328 A * 9/1976 Pearson ..... 292/256
4,004,833 A * 1/1977 Hull ..... 292/288
4,099,754 A 7/1978 Hoebing
4,334,705 A 6/1982 Rumph
4,605,251 A 8/1986 Finlay
4,852,921 A * 8/1989 Gilbert et al. ..... 292/259 R
4,856,831 A 8/1989 Roden, Jr.
4,955,648 A 9/1990 Miller
5,230,541 A * 7/1993 Nowak ..... 292/288
5,340,172 A * 8/1994 Sweet ..... 292/259 R
5,360,245 A 11/1994 David et al.
5,741,033 A * 4/1998 Everett ..... 292/289
5,984,380 A 11/1999 Rice
6,393,878 B1 5/2002 Fayngersh et al.
6,560,925 B1 5/2003 Rice

* cited by examiner

*Primary Examiner*—Suzanne D Barrett
(74) *Attorney, Agent, or Firm*—McGarry Bair PC

(57) ABSTRACT

A security bar for quickly barricading a doorknob-operated, outward-opening door from inside a room, especially useful for fire safety doors used in schools and similar institutions. The bar spans the doorway from the knob to at least one side of the doorframe, with the ends of the bar overlying, and preferably directly engaging, the sides of the doorframe in a non-rotating fashion. The bar has a doorknob-engaging platform that engages the inner doorknob. A clamping member carried by the doorknob-engaging platform normally rests in a storage position out of the way of the doorknob while the bar is being applied to the door, but is quickly activated to clamp the doorknob to the platform. A lock is optionally engaged to lock the clamping member in place and prevent attempts to lift the bar out of engagement with the doorknob. Attempts to force the door open from the outside simply force the bar more tightly against the doorframe.

17 Claims, 12 Drawing Sheets

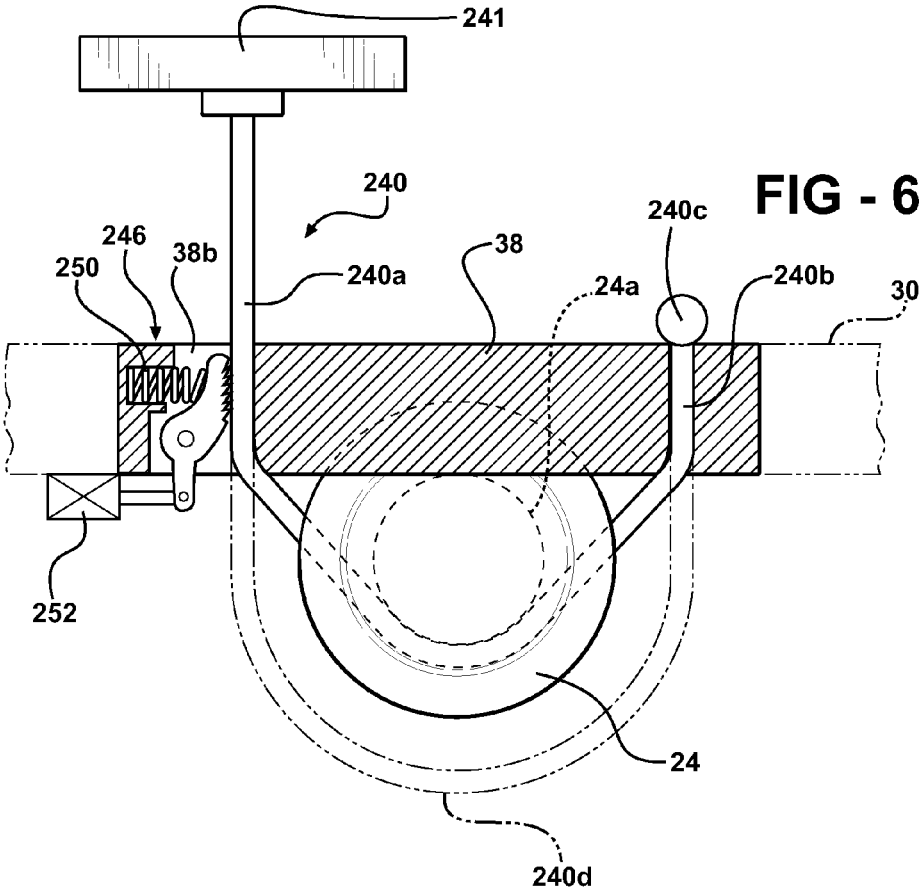
FIG - 6
FIG - 7
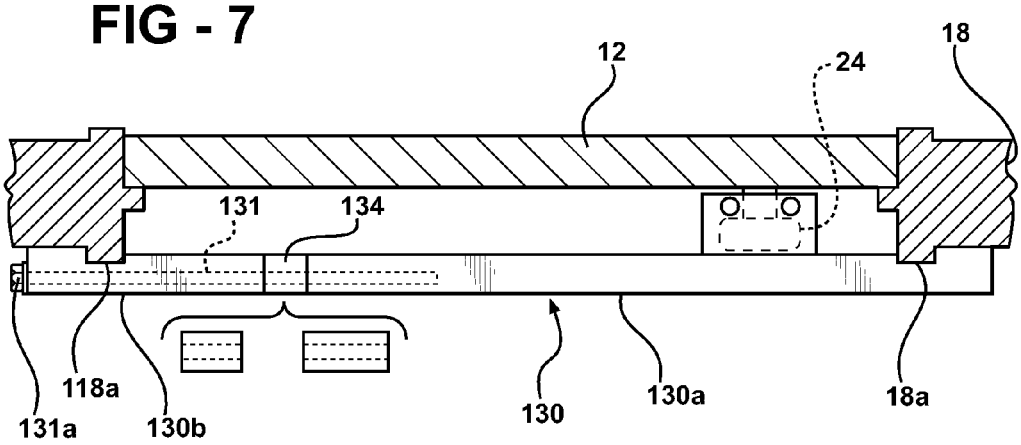

LOCKDOWN DOOR BAR

FIELD OF THE INVENTION

The invention is in the field of security bars for doors.

BACKGROUND OF THE INVENTION AND DESCRIPTION OF RELATED ART

In light of the current national concern over terrorism and mass shootings in schools and other institutional settings, a relatively standardized procedure for responding to a security threat in a school building has been developed: the "lockdown", in which teachers essentially lock themselves and their students in their rooms to deter invaders and await help.

A problem with the lockdown procedure is that fire safety codes typically mandate the use of outward-opening doors, and the use of locks that are key-locked from outside the room and released by simply turning the doorknob from inside the room. These fire safety measures interfere with the speed and security of the lockdown procedure. The teacher must open the classroom door, step outside, and key the lock, exposing himself and the classroom to danger; a panicky student can easily unlock the door from the inside; and if the door has the typical glass window, a gunman can break the glass, reach inside, and unlock the door by turning the inside doorknob.

BRIEF SUMMARY OF THE INVENTION

According to the invention, a horizontal locking bar is provided to quickly and effectively barricade outward-opening, doorknob-operated doors from inside a room without having to open or lock the door. Externally-locked, internally-unlocked doorknobs do not compromise the security of the locking bar, even if the doorknob is left unlocked during the lockdown procedure. "Doorknob" as used herein includes both round knobs and rotating, lever-type handles, and the inventive locking bar is suitable for use with both types.

When placed in its barricade position, the locking bar spans the doorway inside the room, with doorframe-engaging ends that engage the vertical sides of the doorframe in a rotation-preventing manner. The doorframe-engaging ends can be shaped to engage both protruding and recessed doorframes.

The locking bar has a doorknob clamping mechanism with a doorknob-engaging platform and a clamping member movable from a storage position on the platform to a doorknob-clamping position securing the doorknob-engaging platform (and thus the bar as a whole) to the inner doorknob. A lock is optionally (but preferably) provided for locking the clamp in the doorknob-clamping position. The platform can be an integral part of the bar, or separately formed and attached to the bar, depending on the preferred method of manufacture.

The doorknob-engaging platform initially rests on an upper part of the doorknob, preferably for hands-free support of the non-rotating bar while the clamping member is engaged provided the doorknob provides a sufficient rest surface and the bar is balanced accordingly. The platform optionally engages the doorknob in a manner that axially secures the doorknob to the bar for a temporary barricade while the clamping member is being engaged. In a preferred form for round doorknobs, the platform has a cutout or recess sized and shaped to vertically mate with and axially secure an upper portion of the doorknob.

The clamping member in one form is a generally U-shaped member, slidably mounted or hinged on the platform to be interposed between the door and the knob to vertically (and preferably also axially) clamp the doorknob-engaging platform to the doorknob, i.e. preventing the bar from being lifted vertically off the doorknob and preventing the doorknob from being axially disengaged (pulled away from) from the bar.

In one embodiment the clamping member is rigid; in another embodiment the clamping member is flexible. In a preferred form that works with both lever-type and round doorknobs, the clamping member is a rigid J-shaped member that swivels from its storage position before sliding upward to clamp the knob.

The locking means for the clamping member can be manually operated by the person installing the locking bar, or can be designed to engage automatically and to be released by remote signal. The clamping member and/or the locking means can be reusable or disposable.

The doorknob-engaging platform can be adjustable axially toward and away from the door, and/or longitudinally along the bar. The bar can also be made reversible, for use on both rightward opening and leftward opening doors.

While the horizontal bar portion of the locking bar is preferably a solid, non-adjustable piece, it can optionally be made adjustable in length to fit different doorframe widths.

These and other features and advantages of the invention will become apparent from the detailed description below, in light of the accompanying drawings.

BRIEF DESCRIPTION OF THE DRAWINGS

FIG. 6 is a front elevation view similar to FIG. 5, but with an alternate form of clamping member using a flexible cable.

FIG. 7 is a plan view of the doorframe and the installed, locked barricade bar of FIG. 1, illustrating an optional length adjustment for the bar.

DETAILED DESCRIPTION OF THE INVENTION

Figure 1:
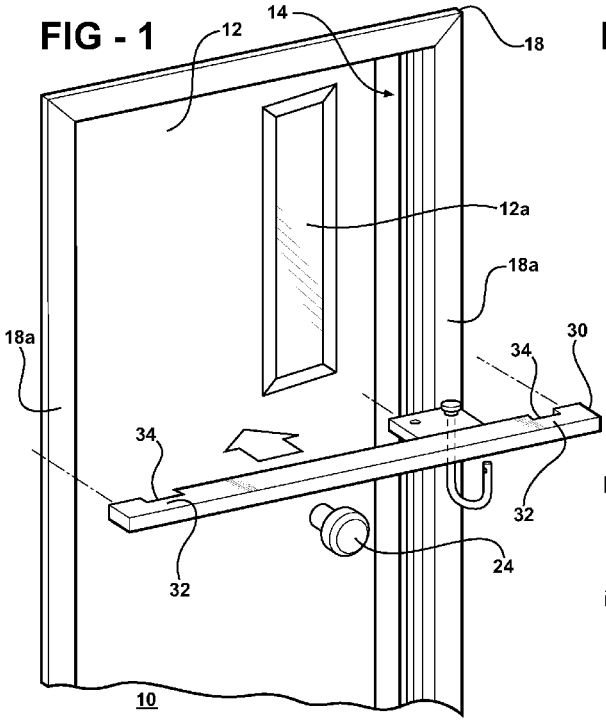
FIG. 1 is a perspective view, from inside a room, of a partially open, outward-opening door with an external key lock, and the barricade bar of the present invention shown prior to applying it to the door.

Referring first to FIG. 1, the invention is illustrated in a preferred example from the perspective of a school classroom 10, with an outward-opening door 12 separating the room from outer hallway 14. Door 12 is mounted in a typical doorframe 18 with protruding vertical sides 18*a*. Door 12 has a doorknob 24, with an outer doorknob (not shown) having an external lock operated by a key. The inner doorknob 24 is without locking features. Door 12 can only be locked via the lock in the outer knob, and this requires someone in room 10 with a key to first open the door when a lockdown is initiated. Once the locked door is pulled closed (FIG. 2), the door is normally unlocked by simply turning inner knob 24, in known fashion.

In the case of a violent intruder, possibilities for gaining access to classroom 10 include interrupting the locking procedure while the door 12 is still open; inducing someone inside to unlock the door via inner knob 24; obtaining a key by force or fraud (or using a key accidentally left in the lock in the outer knob); or, if door 12 is provided with a window such as 12*a*, either built into the door as shown or in the wall next to it, breaking the window and reaching through to operate inner knob 24. The present invention addresses all of these potential weaknesses in the typical lockdown procedure with a barricade bar 30 that locks the inner knob 24 to the doorframe 18.

FIGS. 1 through 4 illustrate a preferred example of barricade bar 30. FIG. 1 shows barricade bar 30 being applied to doorframe 18 by orienting the bar horizontally and pushing the bar 30 axially against the doorframe (as shown by the projection lines and arrow in FIG. 1) to pre-position the bar above the inner doorknob 24. Barricade bar 30 is portable, with a length approximately equal to the width of the doorframe, and so can be easily stored in a corner of the classroom, in a closet, on a wall bracket, or on a bracket concealed under a teacher's desk. Barricade bar 30 has doorframe-engaging ends 32, shaped at 34 to allow the bar 30 to fit over and engage the doorframe sides 18*a* (including any trim over or integral with the frame) in a non-rotating manner. It will be understood by those skilled in the art that the bar's ends 32 can be adapted to fit different types of doorframes, whether the vertical sides of the doorframe protrude from the surrounding doorway (best shown in FIGS. 7 and 7A), or are recessed within the doorway (shown in FIG. 11 at reference numeral 118*a*), provided that bar 30 spans the doorway, i.e. axially engages at least one (and preferably both) of the sides of the doorframe in a non-rotating manner when engaged with the doorknob to prevent the bar from being pulled outwardly through the doorway.

Barricade bar 30 can be made from many different materials, including wood and plastics, but metals such as steel and aluminum are preferable. It will be understood by those skilled in the art that although a generally flat, rectangular bar is illustrated and preferred, the term "bar" is not intended to exclude other shapes and cross-sections, such as bars with rounded cross-sections or the thicker, more block- or plate-like "bars" shown in FIGS. 12A and 12B.

Figure 2:
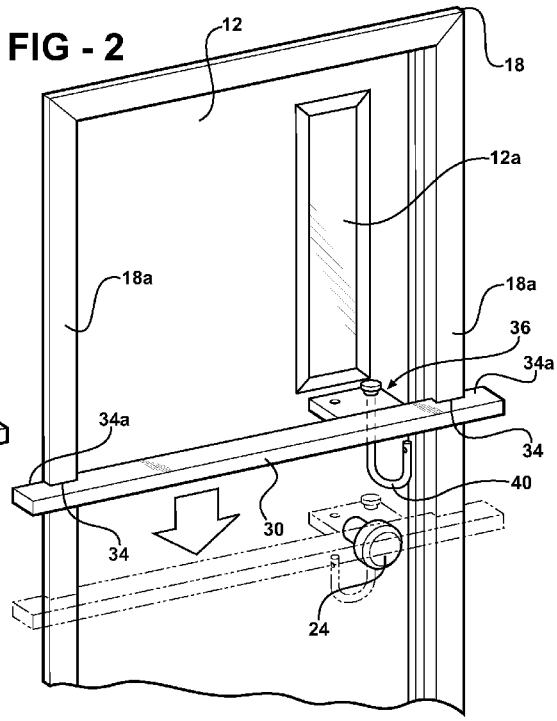
FIG. 2 is similar to FIG. 1, but with the door closed, and the barricade bar shown pre-positioned on the doorframe above the inner doorknob in solid lines, and shown lowered into initial engagement with the doorknob in phantom lines.

FIG. 2 shows barricade bar 30 pre-positioned on the doorframe, with ends 32 engaged with the vertical sides 18*a* of the doorframe above inner doorknob 24, and with a clamping member 40 in a storage position to one side of the doorknob 24. Ends 32 fit over and engage the doorframe sides 18*a* in a manner that prevents bar 30 from rotating in the vertical plane out of its horizontal, doorframe-spanning position, and that allows bar 30 to be guided down in sliding fashion along sides 18*a* onto inner doorknob 24, as shown by the arrow in FIG. 2. While there are many possible ways to form ends 32, recessed channels, lips, or half channels such as 34 approximating the contour of the doorframe, and/or flanges such as 34*a* extending inwardly toward the wall or door, are preferred for initially guiding the ends of the bar 30 onto the doorframe 18 and for preventing rotation of the bar on the doorframe once engaged.

Figure 3:
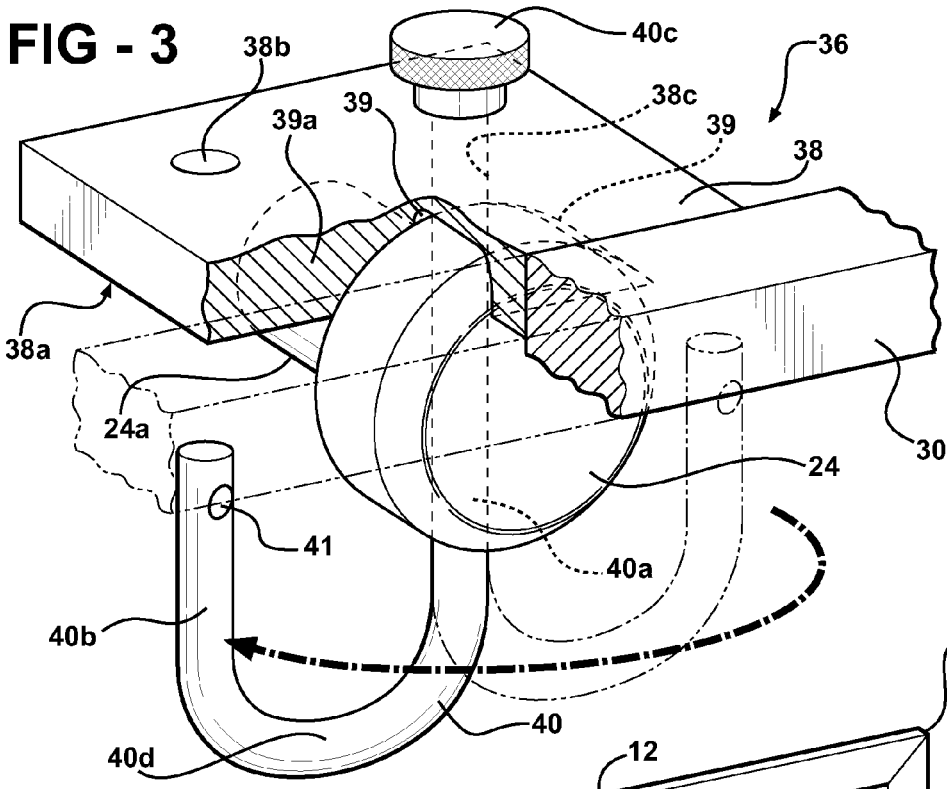
FIG. 3 is a detailed perspective view of the clamping mechanism of FIG. 2 in its initial engagement with the inner doorknob.

FIG. 2 shows barricade bar 30 initially engaged with inner doorknob 24 in phantom lines after sliding bar 30 down along the doorframe. FIG. 3 is a close-up view of the clamping member 40 moved to a pre-clamping position aligned with doorknob 24. Clamping member 40 is part of a clamping mechanism 36 that also includes a doorknob-engaging platform 38 located between the ends of the bar, platform 38 extending inwardly toward and aligned over the inner doorknob 24. The generally U-shaped clamping member 40 (shown in a preferred "J" configuration) is slidably mounted for vertical movement in the platform 38, and normally rests in a "down" storage position as shown in FIGS. 2 and 3 that allows platform 38 to be initially engaged with the doorknob 24.

In the illustrated embodiment of FIGS. 1-3, platform 38 is formed as a block or plate attached to or integrally formed with bar 30. Platform 38 has a recess, slot, or cutout 39, in the illustrated embodiment a blind semi-circular recess (best shown in FIG. 3) opening onto the platform's lower surface 38*a*. The recess 39 is sized and shaped to engage the upper half of inner doorknob 24 above stem 24*a*. Accordingly, as barricade bar 30 slides down the doorframe, recess 39 drops onto and mates with the upper portion of doorknob 24, temporarily holding the non-rotating bar 30 in place and freeing the user's hands to operate the clamping mechanism. Because the inner wall or flange 39*a* of recess 39 is interposed between the knob and the door, platform 38 not only vertically supports bar 30 on the doorknob, but also axially connects the doorknob 24 to bar 30 for a temporary barricade that resists the door being pulled open.

The length of bar 30, the shape of its doorframe-engaging ends 32, and the location and dimensions of clamping mechanism 36 can be manufactured to fit a specific door/frame/knob combination. However, because doorframes can vary, and because doorknob styles and sizes can also vary, the interfaces between doorframe 18, bar 30, and doorknob 24 can vary; bar 30 can be adjustable in length; and platform 38 can be attached to bar 30 in removable and/or adjustable fashion. For example, the platform 38 can be connected to bar 30 with bolts (FIG. 7A) extending from the front face of bar 30 through the bar and into threaded bores in the platform 38. If the size and/or shape of doorknob-engaging recess 39 does not properly fit the inner doorknob 24, or if the size or shape of platform 38 or recess 39 does not match the doorknob, platform 38 can be moved to a different location on the bar 30 in better alignment with the doorknob, or it can be detached and a different platform can be substituted.

FIG. 3 illustrates clamping member 40 as a generally U-shaped (more particularly a J-shaped) rigid cylindrical bar, made from a high quality hardened steel. Clamping member 40 is slidably mounted for vertical movement on platform 38, with its two legs 40*a* and 40*b* sliding in corresponding vertical bores or holes 38*b* and 38*c* formed in the platform. The longer leg 40*a* of the "J" is slidably trapped in platform 38 by a stop member 40*c* at its upper end, for example a nut or disc, so that clamping member 40 is retained in the platform 38 in its "down" position when the barricade bar 30 is in storage and while the bar 30 is being deployed. The shorter leg 40*b* of the J-shaped clamping member preferably ends below platform 38 and bar 30 when in the "down" position shown in FIG. 3, so that it can be swiveled from the doorframe-engaging position shown in FIG. 2 to the pre-clamping position of FIG. 3.

It will be understood that the term "U-shaped" as applied to clamping member 40 is meant to include any shape extending below platform 38 to form a loop capable of being substantially closed around the doorknob stem to trap the doorknob below the platform, whether the loop is rounded or squared, and includes the preferred J-shape shown in FIGS. 1-4. It will also be understood that reference to platform body 38 as a block or plate is not intended to limit it strictly to a particular shape, since different shapes or thicknesses will be suitable as long as the platform 38 has sufficient strength and size to engage or at least overlie the upper part of the doorknob 24, and to provide a secure platform for clamping member 40. For J-shaped clamping members, it is helpful to lengthen the bores in which the clamping member slides up and down in the platform plate, in order to reduce the tendency of the long leg 40*a* of the clamping member to cock-up or bind and stick in bore 38*c* before the shorter leg 40*b* arrives in bore 38*b*.

Figure 4:
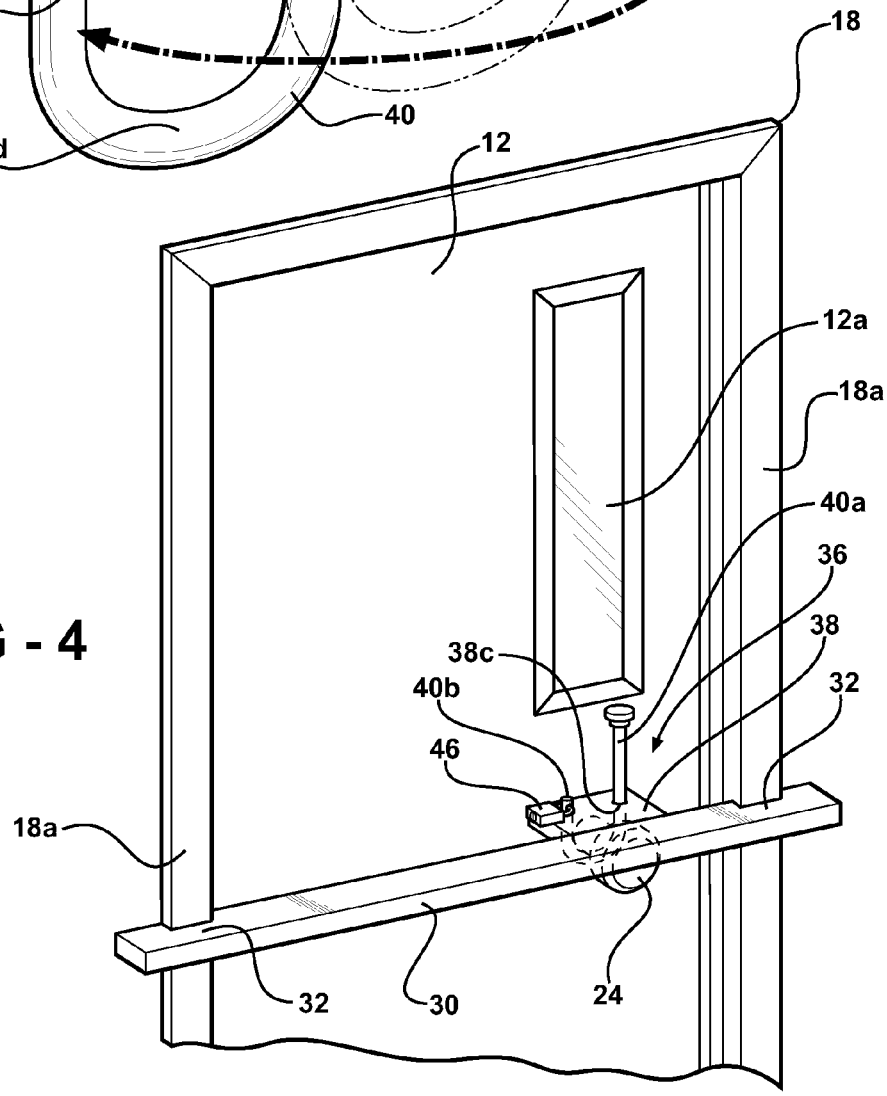
FIG. 4 is a perspective view of the barricade bar of FIG. 1, with the clamping mechanism fully engaged with the inner doorknob and locked in place.
Figure 4A:
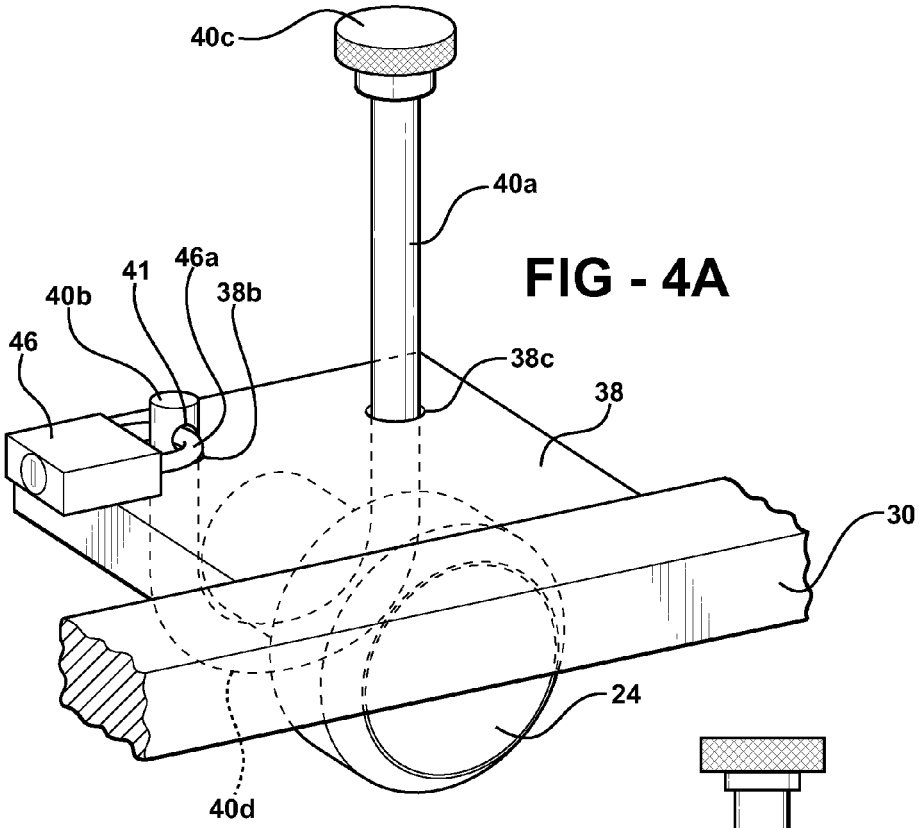
FIG. 4A is a detailed perspective view of the fully engaged and locked clamping mechanism of FIG. 4.

FIGS. 4 and 4A show clamping mechanism 36 fully engaged with doorknob 24. While platform 38 rests on and temporarily holds the upper half of doorknob 24, clamping member 40 is pushed or pulled upwardly from its pre-clamping position (FIG. 3) to its clamping position (FIGS. 4 and 4A), so that short leg 40*b* rides up into the matching bore 38*b* in platform 38, and so that its loop or bight 40*d* rides up behind the lower half of doorknob 24 underneath doorknob stem 24*a*, between the knob and the door. It is preferred that the loop or bight 40*d* engage the inner face of the doorknob 24 in a tight wedge- or cam-fit in this raised position (see FIG. 8), in order to generate forces that tend to further press the ends of bar 30 against the doorframe, and to prevent any movement of the door once clamped. The J-shaped clamping member 40 accordingly can no longer swivel out of engagement with the doorknob 24, and bar 30 cannot be lifted vertically back up the doorframe to disengage platform 38 from doorknob 24. Clamping member 40 is then locked in this raised, clamping position with any of a number of locking means, in the illustrated example of FIG. 4 with a simple padlock 46 whose shackle 46*a* is inserted through a hole 41 formed through leg 40*a* at a location that exposes hole 41 above the upper surface of platform 38 in the clamping position.

Still referring to FIG. 4, anyone outside room 10 trying to pull door 12 open simply forces the ends 32 of bar 30 more tightly against the doorframe 18 via the inner doorknob's engagement with clamping mechanism 36. Lock 46 on clamping member 40 prevents the bar from being unlocked and lifted off doorknob 24 by an intruder reaching through a broken glass window, or by unauthorized or frightened people inside the room. The preferred wedge fit of the clamping member against the back face of the doorknob also prevents an intruder from rattling or shaking the door back and forth to generate any impact force or gaining any leverage against the bar and clamp and doorknob. In the most preferred form, the rear edge of the platform plate 38 is a close fit against the door to further prevent leverage that could potentially break the doorknob.

Figure 5:
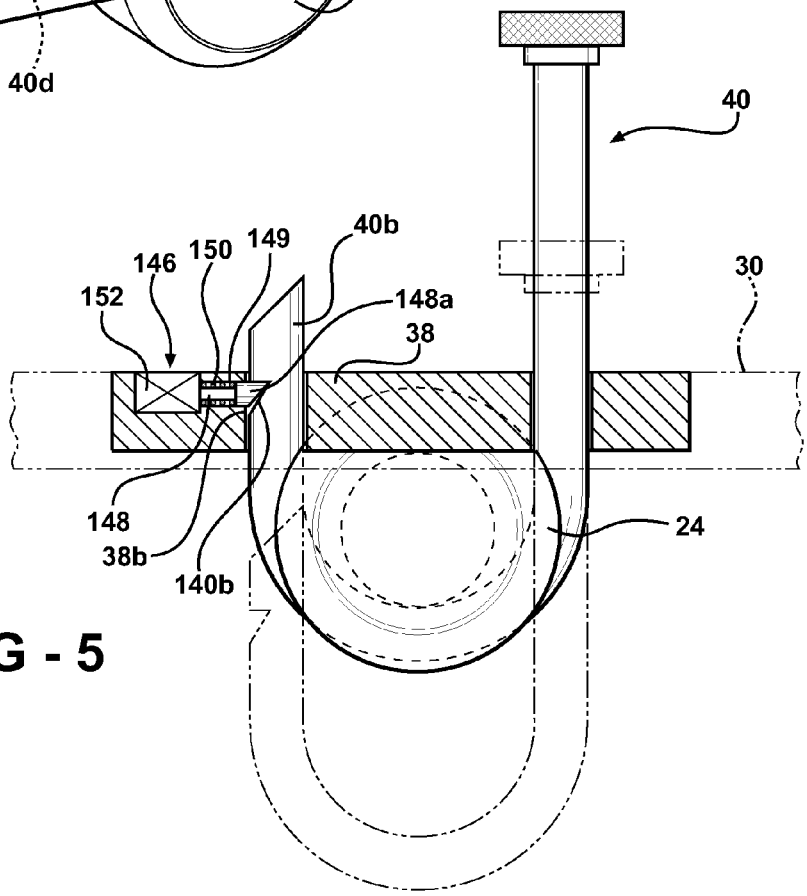
FIG. 5 is a front elevation view showing an alternate, automatically engaged and remotely released lock for locking the clamping mechanism to the doorknob.

In order to further prevent the possibility of the barricade bar being unlocked from inside the room, or by someone reaching through a broken window with a key to the padlock 46, and to increase the speed of the bar's deployment, an alternate, automatically-engaged locking mechanism 146 is illustrated in FIG. 5. Automatic lock mechanism 146 includes a transverse latching member 148 mounted to move in a bore 149 in bar 30. Transverse bore 149 opens into the vertical bore 38*b* that the short clamping member leg 40*b* enters during the clamping operation. Locking pin 148 is normally biased by a spring 150 to extend partway into vertical bore 38*b*, until it is pushed back (leftward in the drawing) by the upward movement of clamping member leg 40*b*, assisted for example by an angled cam surface 148*a* formed in the free end of the pin. Leg 40*b* is modified with a detent or through-hole 140*b* located to receive pin 148 when clamping member 40 is fully engaged, automatically locking the clamping member in place in a tamperproof manner.

Still referring to FIG. 5, pin 148 and spring 150 are part of a remote-controlled, solenoid-retracted unlatching mechanism 152 mounted on or in platform 38, similar for example to those used in remote-controlled automobile door lock mechanisms. Transmitting an "all-clear" signal to locking mechanism 146 causes solenoid 152 to retract pin 148 out of engagement with clamping member 40, against the force of the spring, allowing the clamping member to drop freely back down to its pre-clamping position, where it can be swiveled out of alignment with the doorknob to remove barricade bar 30 from the door and doorframe. The wireless unlatching signal can come from a handheld remote control in the possession of a teacher, or from security personnel clearing the building, or can be a building-wide signal transmitted from a central office.

It will also be understood that while a remote-control, radio-operated type release is the preferred embodiment shown schematically in FIG. 5, a manually-operated release is also possible, for example a key-lock or keypad of generally known type built into bar 30 or plate 38 and capable of retracting spring-loaded latching member 148 with the turn of a key or the entry of a combination. It will also be understood that the spring-loaded latching member could be built into the clamping member, for example a ball-type detent in leg 40*b*, latching with a suitable recess in bore 38*b* and releasable with a shim.

FIG. 6 illustrates an alternate clamping member 240 with a different type of automatic locking mechanism 246. Clamp 240 is a flexible, generally U-shaped member whose short leg 240*b* is fixed to platform 38, for example with an end stop 240*c*, and whose long leg 240*a* terminates in a pull handle 241. In the preferred, illustrated embodiment, clamp 240 is a cut-resistant steel cable, although other flexible members could be used depending on the desired strength of the clamp. Cable clamp 240 normally hangs down in a rest position during storage, as shown in phantom. Although pull handle 241 could be designed to be inserted through bore 38*b* in platform 38 during an emergency, it is preferred that long leg 240*a* normally remain in bore 38 with pull handle 241 resting on top of the platform. The width of the loop portion 240*d* hanging below platform 38 is preferably greater than the width of the doorknob, allowing bar 30 to be engaged axially over the doorknob; the flexibility of cable 240 allows bar 30 to be engaged vertically with the doorknob as shown in FIG. 2 by moving the loop 240*d* out of the way of the doorknob as barricade bar slides down the doorframe 18.

Once pre-engaged with the doorknob (phantom lines in FIG. 6), pull handle 241 is pulled upwardly, drawing the slack in loop 240*d* up through bore 38*b* until the cable engages the doorknob stem (solid lines in FIG. 6). Cable clamp 240 is preferably locked in place with an automatic locking mechanism such as the one shown schematically at 146. A one-way toothed cam 248 is biased by a spring 250 into constant contact with the cable. Cable 240 can accordingly be pulled up through platform 38 to tighten loop 240*d* against the doorknob stem, but cannot be retracted to unlock the bar 30 from the doorknob unless the cam 248 is released, for example with a solenoid unlatching mechanism 252 operated by a remote control signal as described above, or with a key, or both.

FIG. 7 shows a modified barricade bar 130 whose length can be adjusted to fit different doorframes. Bar 130 has two main sections, 130*a* and 130*b*, joined by an adjustment bolt 131 extending through aligned bores formed in the bar sections, and with an exposed head 131*a* at one end of the bar. The bore in the longer main bar portion 130*a* is at least partially threaded so that operating the bolt 131 serves to either draw the bar sections together or force them apart, depending on the direction the bolt is rotated. One or more spacer sections 134 with matching bores are provided to insert between main bar sections 130*a* and 130*b* as needed to accommodate different doorframe widths. Once bar 130 has been lengthened or shortened to match the doorframe 18, the bar is ready to be stored for use in an emergency. While a bolt-operated length adjustment for bar 130 is shown, it will be understood that other forms of length adjustment could be used.

Figure 7A:
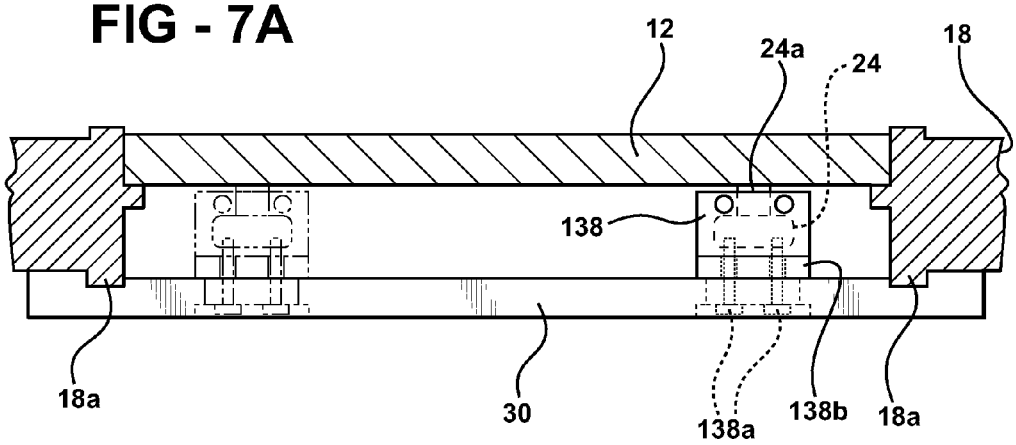
FIG. 7A is a plan view similar to FIG. 7, but illustrating an optional position adjustment for the doorknob-engaging platform.

FIG. 7A shows a barricade bar with a modified doorknob-engaging platform 138, in which the platform is attached to bar 30 with two adjustable bolts 138*a* extending through bar 30, and including one or more spacers 138*b* that can be added and removed to platform 138 as needed to adjust the distance platform 138 extends toward door 12 to properly overlie and engage doorknob 24. By placing multiple sets of holes or slots for bolts 138*a* along the length of bar 30, the position of platform 138 along the length of bar 30 could also be adjusted, as shown in phantom.

Figure 8:
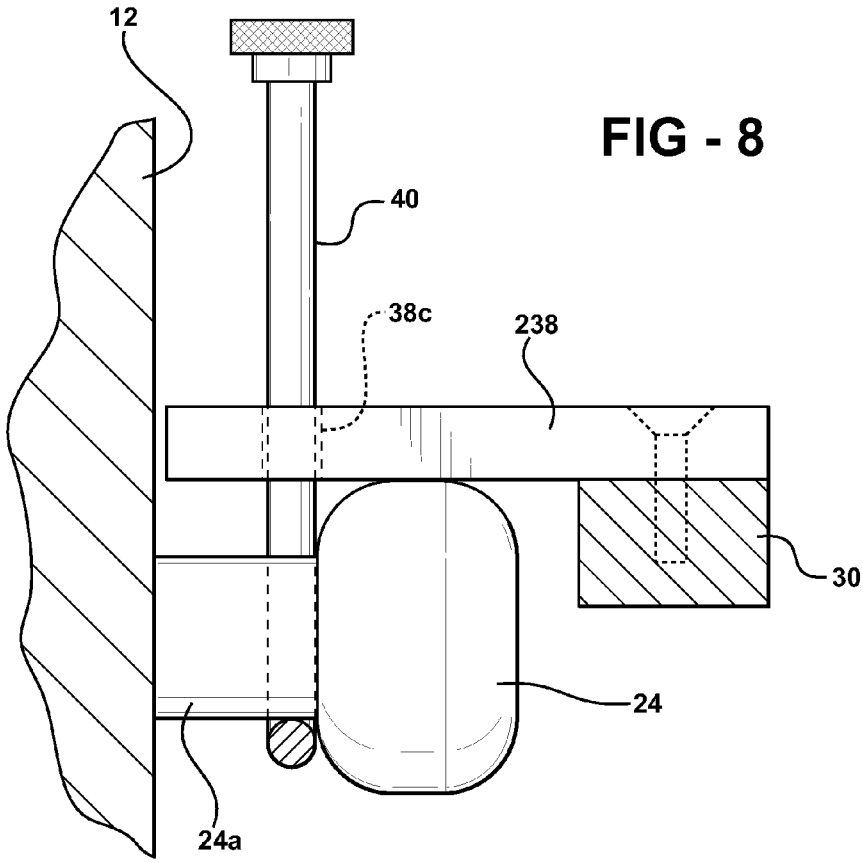
FIG. 8 is a side elevation view showing a first alternate embodiment of the doorknob-engaging platform.

FIG. 8 illustrates another modified doorknob-engaging platform 238. Platform 238 is essentially a flat piece that merely rests on top of doorknob 24 in the pre-engaged position. If sized and balanced properly, this might still allow barricade bar 30 to temporarily stay in place on the doorframe 18 and knob 24 while the clamping member 40 is being engaged and locked, but would not prevent the door 12 from being pulled open until the clamping member is engaged. Flat platform 238 has the advantage of being compatible with most styles of doorknob.

Figure 9:
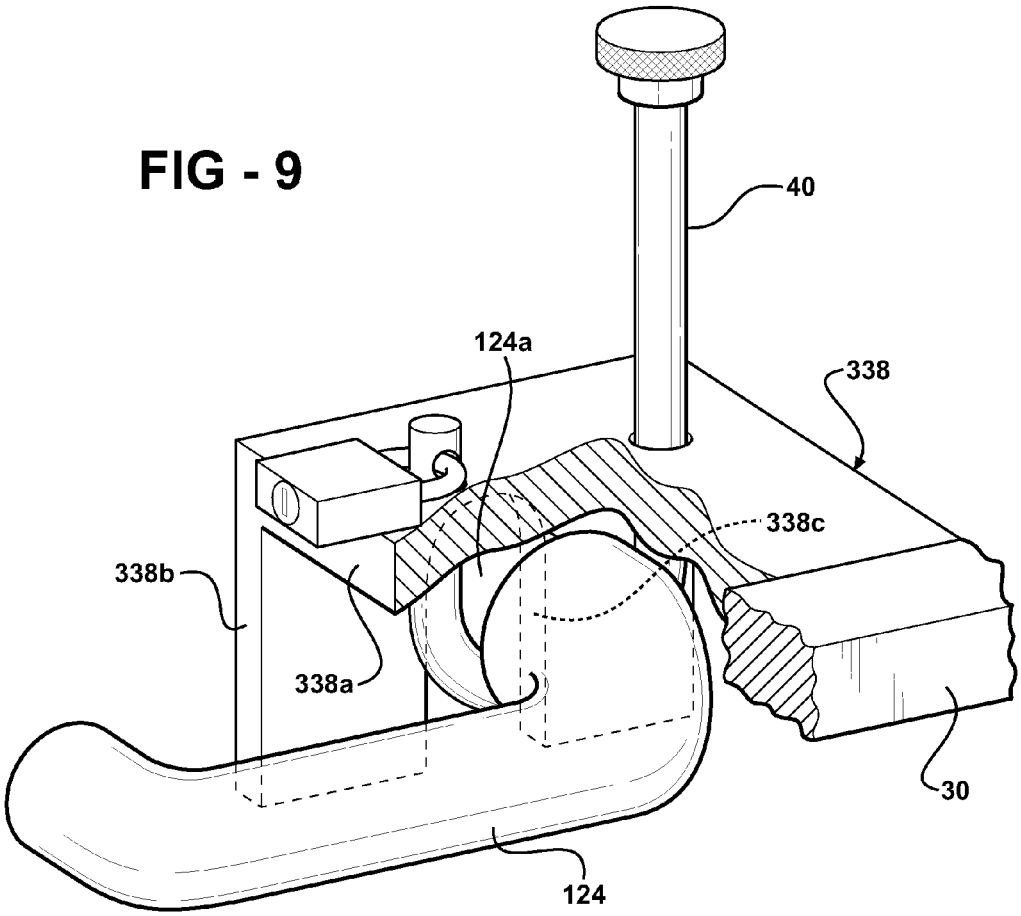
FIG. 9 is a perspective view, similar to FIG. 3, but showing a second alternate embodiment of the doorknob-engaging platform, in use with a lever-handle type doorknob.

FIG. 9 illustrates yet another modified doorknob-engaging platform 338, in which a flat horizontal platform plate 338*a* is provided with a vertical, downwardly-extending flange 338*b* interposed between the rear face of the doorknob and the door. In the case of a lever type handle such as 124, flange 338*b* is located behind the handle portion, and is preferably wide enough to be slotted at 338*c* to drop down over the doorknob stem 124*a* to extend below the handle 124 between the handle and the door. This modified platform 338 strongly resists the door being pulled open even before the clamping member 40 has been engaged and locked. The downwardly extending flange 338*b* also helps hold the bar at rest on the doorknob while any clamping member and lock are being engaged. In some cases, for the simplest application of the bar to the door, it might be sufficient to simply drop the flange-equipped bar into place without a separate clamping member and lock, for an expedient barricade.

Figure 10A:
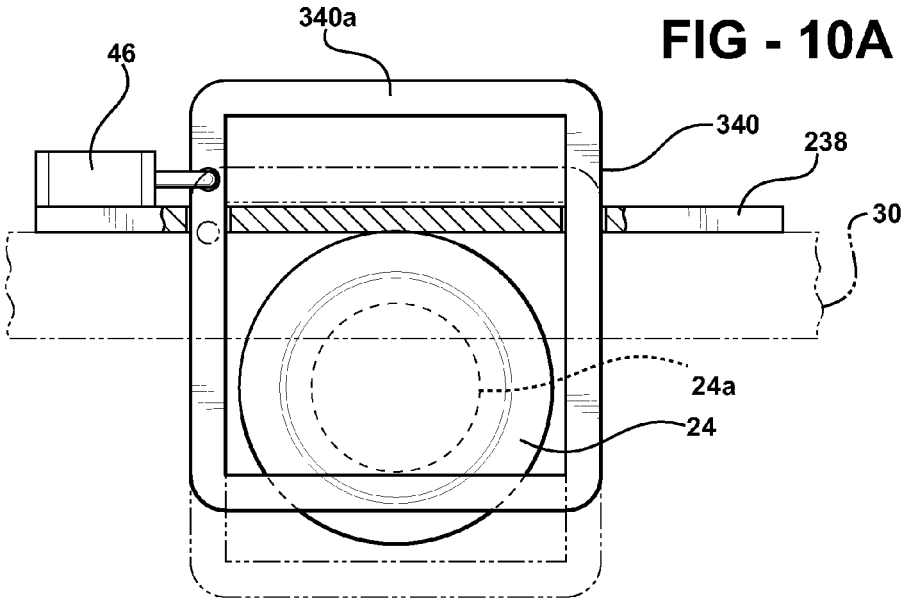
FIGS. 10A-10C are front elevation views, similar to FIG. 5, showing alternate embodiments of U-shaped clamping members.
Figure 10B:
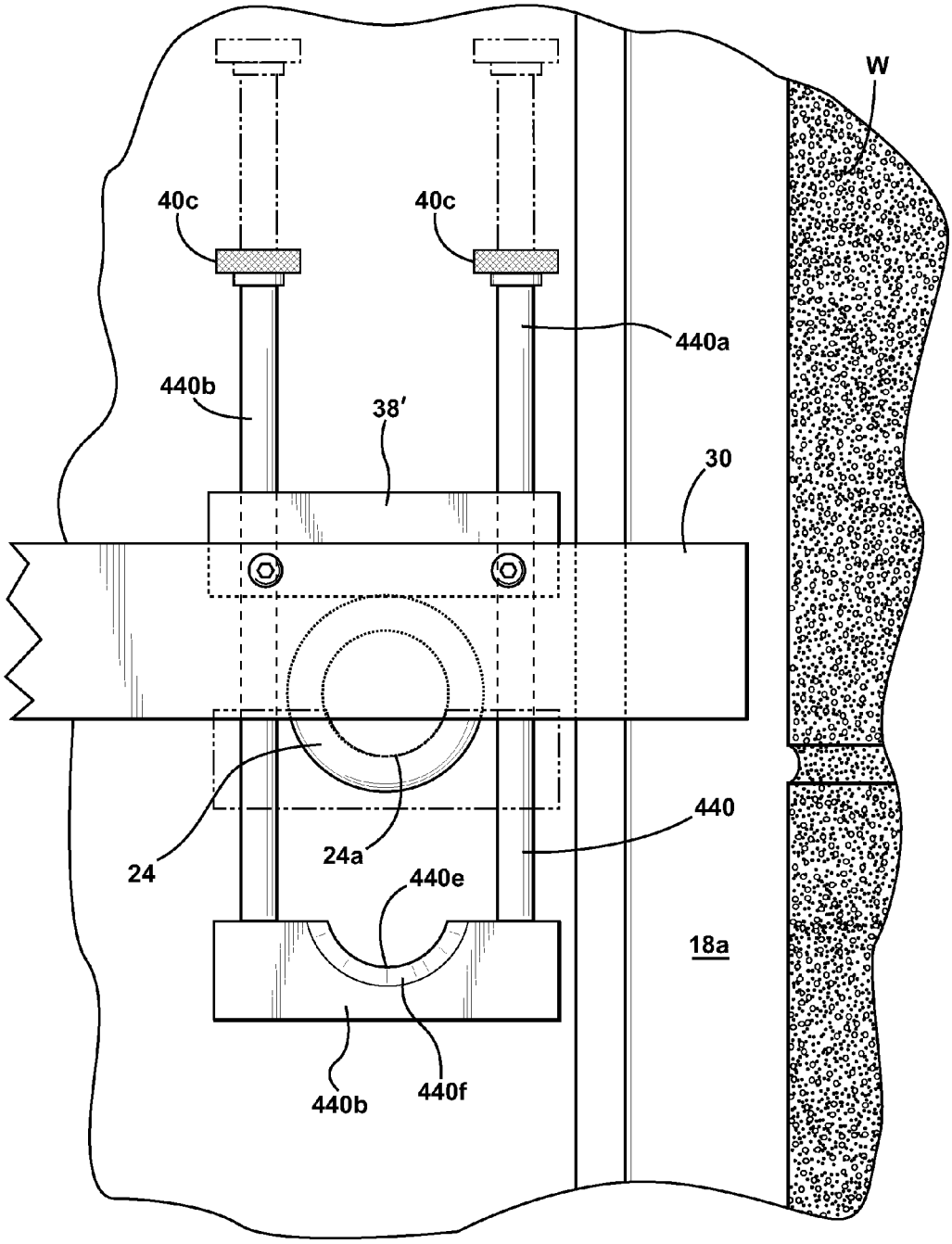
Figure 10C:
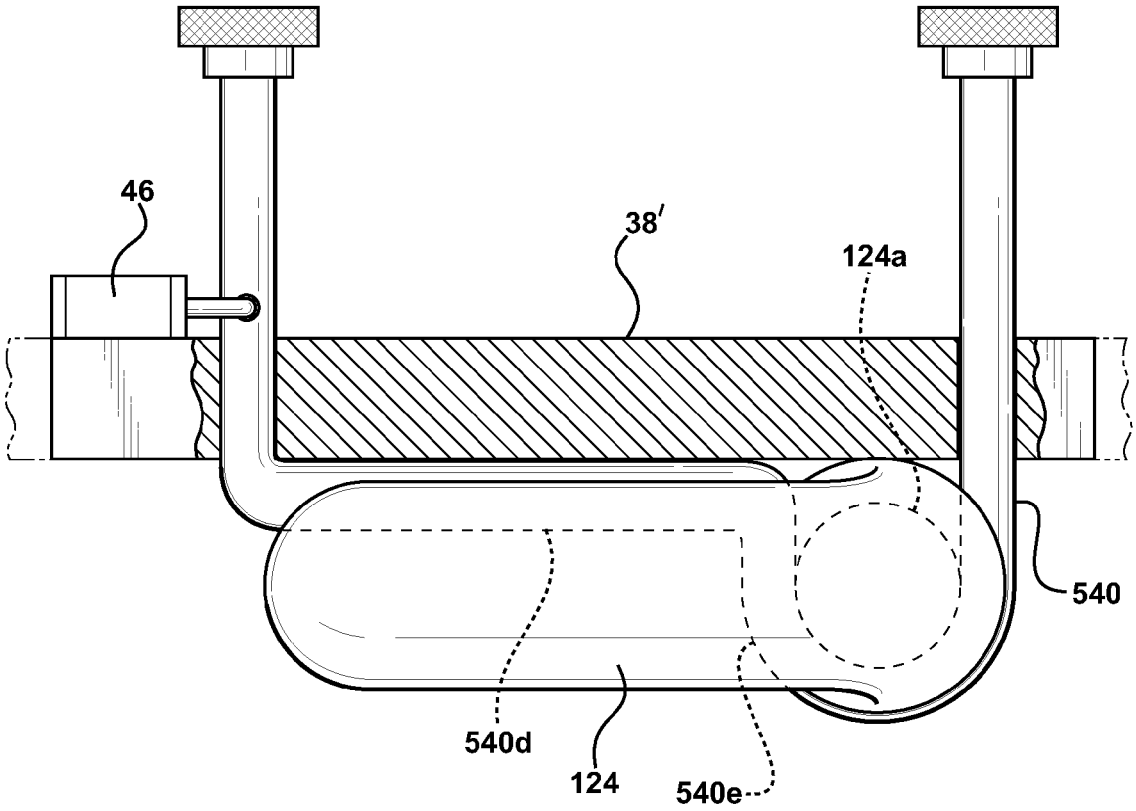

FIGS. 10A through 10C illustrate alternate U-shaped rigid clamping members 340 and 440 and 540, trapped for vertical sliding movement in the platform plate 38. The clamping members have vertical legs of equal length, trapped in platform plate 38 with stops such as 40*c* on their upper ends (FIGS. 10B and 10C), or with a bar portion 340*a* connecting the ends of the vertical legs (FIG. 10A). The widths or diameters of their loop portions below bar 30 are wider than the doorknob, and in the case of clamping member 540 in FIG. 10C the loop portion 540*d* is provided with a narrower secondary loop portion 540*e* adapted to engage the stem 124*a* for a lever style handle, while the horizontal portion 540*d* rides up behind the horizontal portion of handle 124 either flush with the bottom of the platform plate, and preferably even recessed into a channel in the platform plate, to prevent prying. Clamping members 340 and 440 and 540 accordingly remain in axial alignment with doorknob 24, requiring them to be initially engaged with the doorknob 24 in an axial direction while in the "down" position shown in phantom lines, rather than applied in a vertically downward direction and then swiveled into clamping engagement with the doorknob as with the J-shaped swiveling member shown in FIGS. 1-4. Clamping member 440 in FIG. 10B uses a yoke 440*d* with a rounded recess 440*e* to engage the doorknob stem 24*a*, rather than a rounded loop or bight portion, and the yoke can be chamfered at 440*f* on its front face to facilitate a wedge fit against the back of the doorknob.

Figure 11:
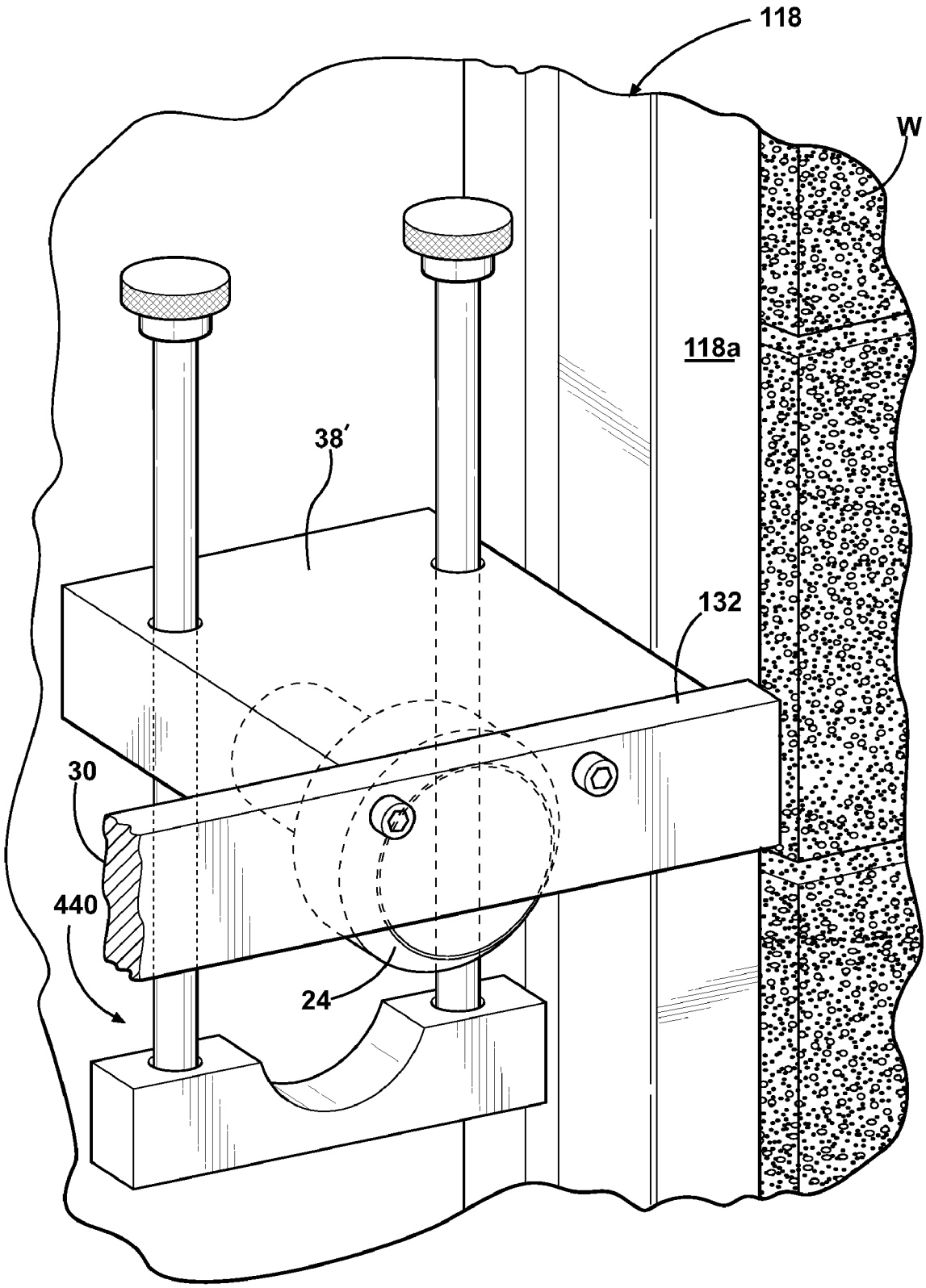
FIG. 11 is a perspective view of an alternate embodiment of a locking bar according to the invention, in use with a recessed doorframe.

FIG. 11 shows a doorway with a doorframe 118 recessed into a wall W defining the doorway, and with recessed sides 118*a* (only one side of the doorway is shown in FIG. 11, the opposite side being identical). Bar 30 is modified with ends 132 adapted to fit within the recessed doorway, with a relatively close fit (for example on the order of two millimeters' tolerance) between the opposing sides of wall W in order to achieve a non-rotating fit in the doorway when pressed against doorframe sides 118*a* with platform plate 38' resting on the doorknob 24. The clamping mechanism can then be operated in the manner as described above. Clamping mechanism 440 is shown by way of example, but any of the clamping mechanisms described and illustrated above would work. Platform plate 38' shown in FIGS. 10B, 10C, and 11 is thicker than the platform plates shown in earlier Figures, in order to provide longer sliding bores for the vertical legs of the clamping member.

Figure 12A:
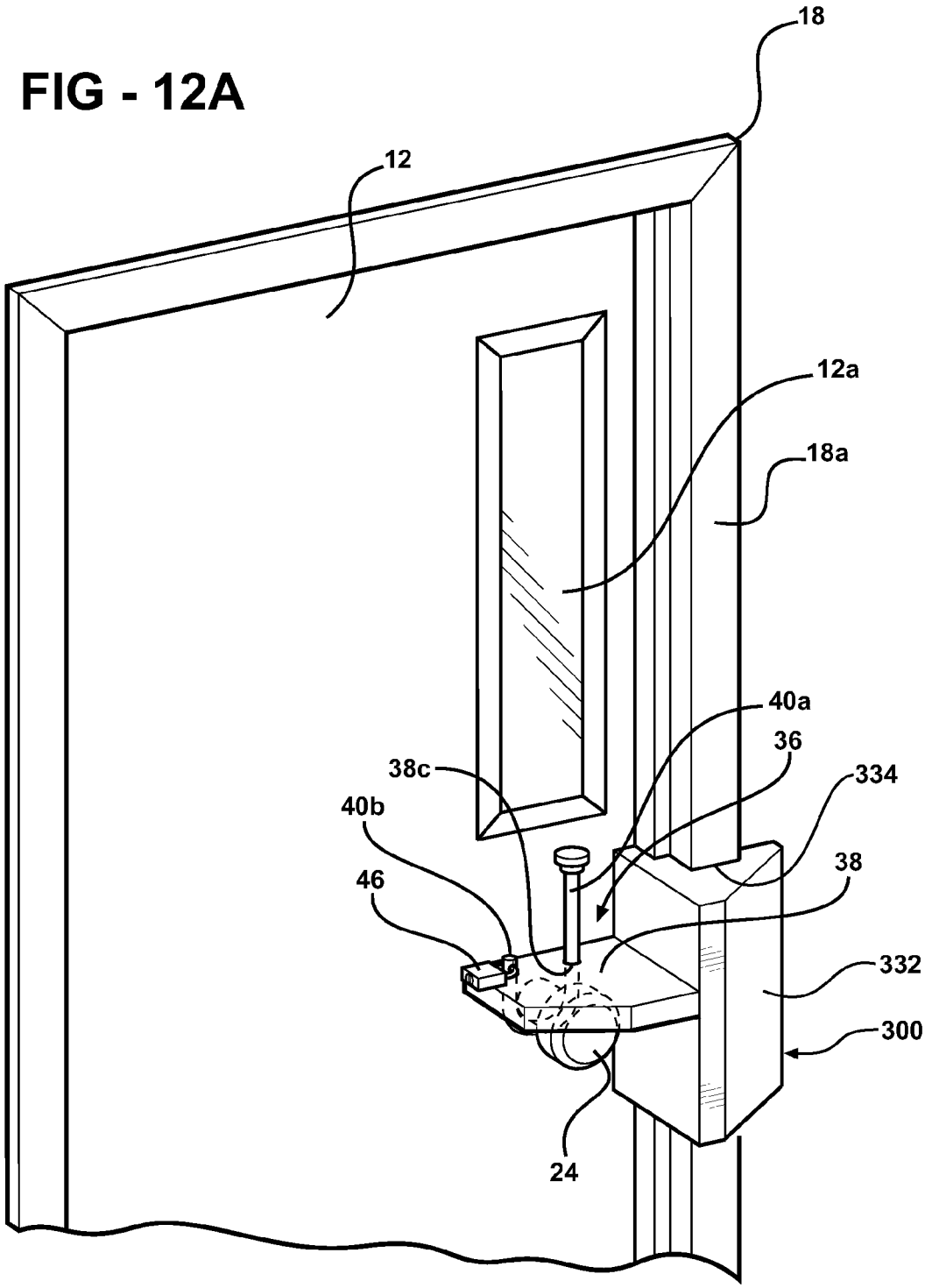
FIGS. 12A-12B are perspective views of alternate embodiments of a locking bar according to the invention, in which the bar engages only one side of the doorframe.
Figure 12B:
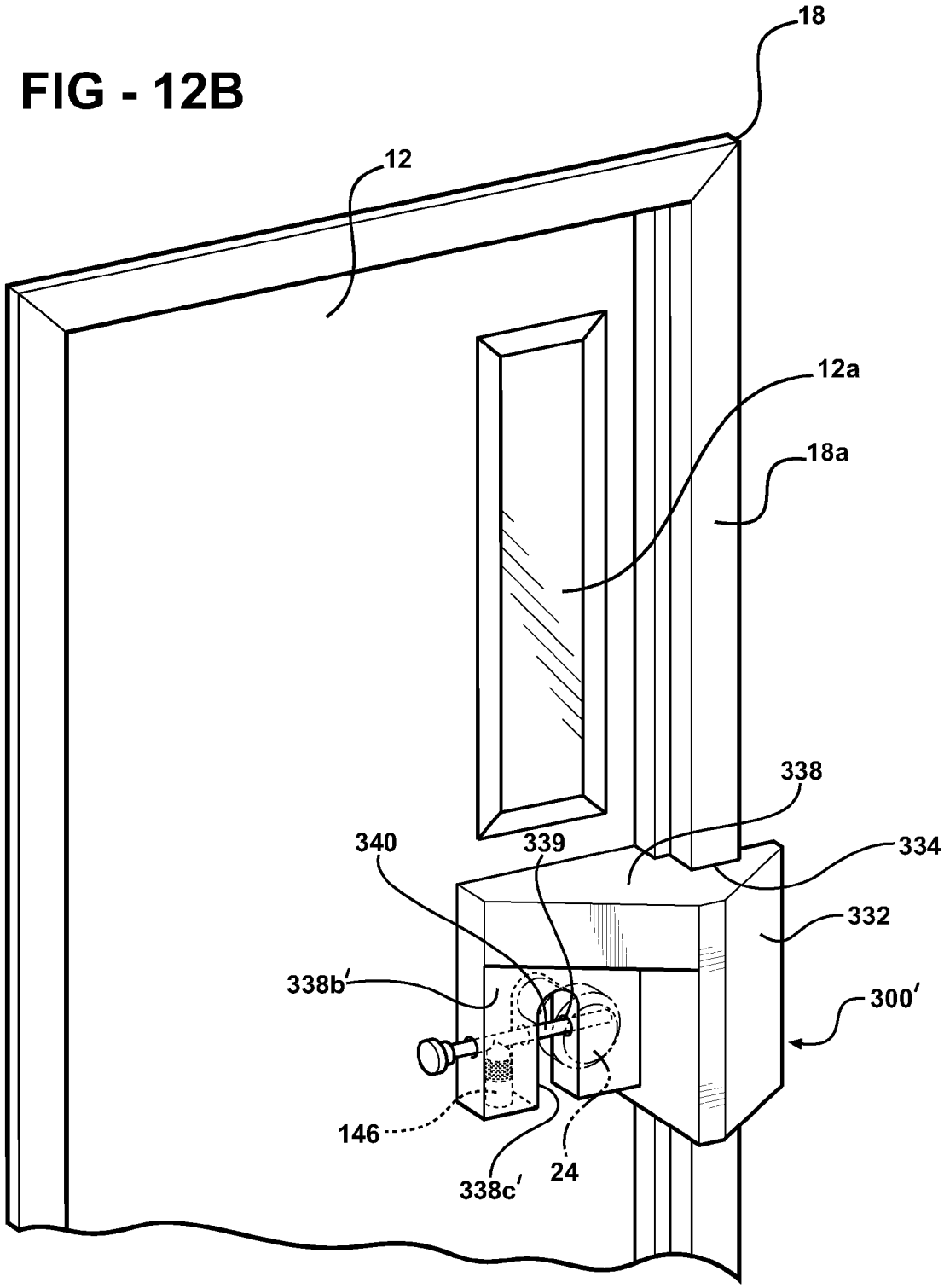

FIGS. 12A and 12B show modified barricade bars 300 and 300', applied to the doorframe and clamped in a manner similar to the bar 30 shown in earlier Figures, but shortened in length, and their doorframe-engaging ends extended in height, to engage only one side of the doorframe 118. The clamping mechanism and operation of the "one-sided" bars 300 and 300' is otherwise similar to bar 30 as described above, except that the fit of the recess or contour 334 in the doorframe-engaging end 332 should more fully match and wrap around the contour of the doorframe. This closely-contoured, wrap-around fit to the doorframe, coupled with the increase in surface area engaging the doorframe due to the extended height of the doorframe-engaging end of the bar, would better resist the leverage generated through the doorknob at the other end. It also would serve to resist rotation of the bar relative to the doorframe.

FIG. 12B shows a further variation of the one-sided bar 300, with modified bar 300' having a modified doorknob-engaging platform 338, with a downwardly-extending flange 338*b*' having a downwardly-opening slot 338*c*' shaped and positioned to fit over the doorknob stem, similar to the flange structure 338*b* and 338*c* in FIG. 9. A transverse clamping member 340, in the illustrated example a transverse sliding pin locked with an internal detent or regular padlock such as 46, replaces the U-shaped clamping member shown in the preceding Figures. Pin 340 slides back and forth in appropriate bores 339 formed in the flange portion 338*c*' to vertically clamp the bar to the doorknob 24, preventing the bar from being lifted off the doorknob. Transverse pin 340 slides underneath the doorknob stem, and is preferably sized and shaped to have a wedge fit against the back face of the knob when pushed all the way in, for the additional advantages described above in relation to the clamping members of FIGS. 1-11. The modified bar 300' also exhibits a thickened doorknob-engaging platform 338 relative to the platform 38 in FIG. 12A, in order to strengthen and better unify the junction of the platform 338 with the doorframe-engaging end 332. While pin 340 is shown as being generally horizontal, it could also be set to be inserted and engaged with the underside of the doorknob at an acute angle, for example sliding into flange 338*b*' and underneath the doorknob stem at a 45-degree angle from the upper left side of flange, allowing gravity to assist the clamping operation.

FIGS. 12A and 12B show doorknob-engaging platforms 38 and 338 that form most or all of the horizontal doorframe-spanning portions of their respective "one-sided" bars 300 and 300', which are significantly shorter than their "two-sided" counterparts that span the entire doorway and engage both sides of the doorframe in the earlier Figures. This makes bars 300 and 300' easier to store; it also makes them well-suited to being manufactured in a single piece, for example by molding from suitable plastics, although all of the barricade bar embodiments disclosed herein are capable of having their horizontal bar portions and doorknob-engaging platform portions formed in a single piece if desired. It should also be understood that the transverse clamping pin 340 of FIG. 12B could be applied to the previous examples of barricade bar using a downwardly-extending flange such as 338*b*, in place of the U-shaped clamping members.

Figure 13:
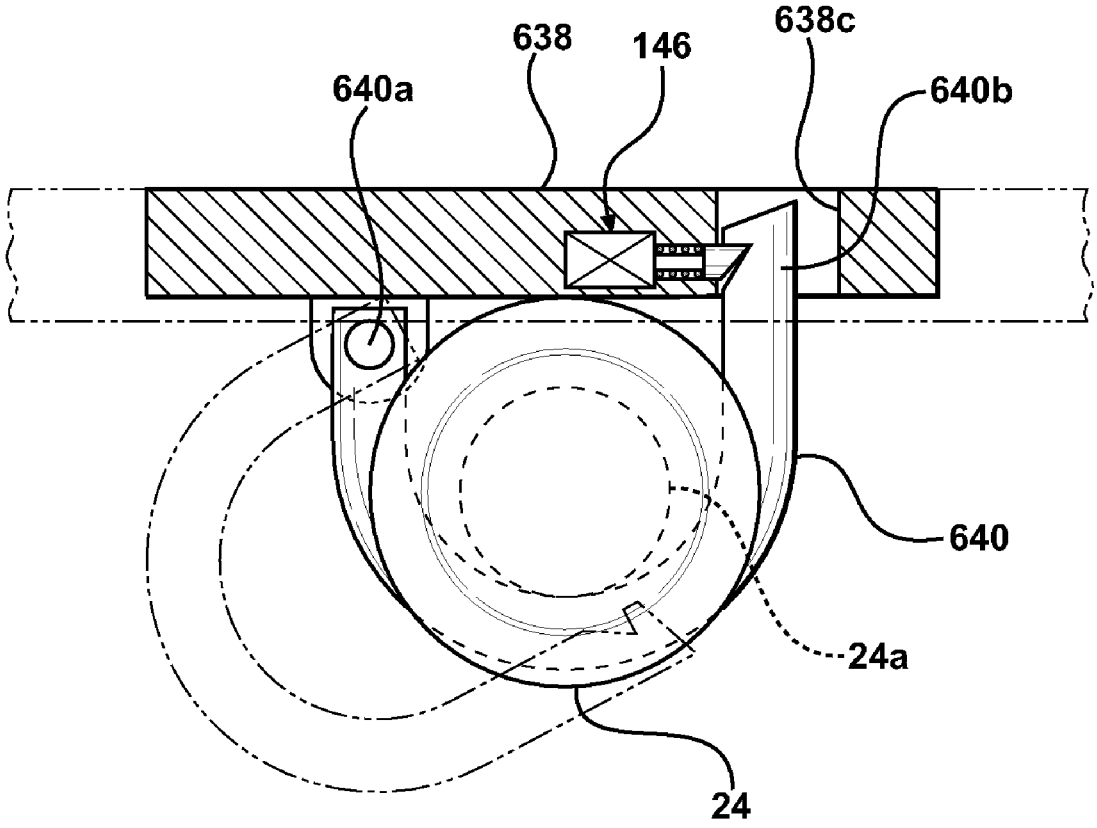
FIG. 13 is a front elevation view of a hinged embodiment of the clamping member.

While the clamping members illustrated above have all shown a preferred sliding adjustment on the extension plate to clamp the doorknob, other forms of clamping movement are possible. Referring to FIG. 13, a J-shaped clamping member such as 640 could be hinged to the underside of an extension plate 638 as shown at 640*a*. The weight and balance of clamping member 640 would preferably cause it to normally hang out of alignment with doorknob 24. The clamping member 640 would then be swung up into clamping engagement with doorknob stem 24*a* when the barricade bar has been positioned, and the free leg 640*b* of the clamping member could then be locked in place in opening 638*c* using an automatic detent 146 or a padlock or other locking mechanism.

It will be understood that, although the barricade bar has been described in its preferred use for an institutional lock-down procedure, it can be used to barricade similar doors in different situations. While the barricade bar has been described in connection with its primary role as a barricade to bar an intruder from entering a room or building with an outward-opening door, it might also be used to barricade someone inside a room or building with an inward-opening door, with the terms "outward-opening" and "inner" and "inside" being considered relative to the person employing the barricade bar. It will also be understood that the disclosed embodiments are representative of presently preferred forms of the invention, but are intended to be explanatory rather than limiting of the invention. Reasonable variations and modifications of the invention as disclosed in the foregoing disclosure and drawings are possible without departing from the scope of the invention. The scope of the invention is defined by the following claims.

What is claimed:

1. A barricade bar for barricading a doorknob-equipped, outwardly-opening door from inside a room without having to open the door or operate a doorknob locking mechanism from the outside of the room, the barricade bar comprising:

a locking bar adapted to extend generally horizontally from an inner doorknob to engage at least one of the vertical sides of a doorframe in a non-rotating manner; and a doorknob clamping mechanism comprising a doorknob-engaging platform extending from the bar to overlie the doorknob when the bar is engaged with the doorframe;

the doorknob clamping mechanism further comprising a generally U-shaped clamping member slidably mounted in the doorknob-engaging platform with a loop portion extending below the doorknob-engaging platform, comprising a first, short leg normally resting below the doorknob-engaging platform, and a second, long leg trapped in the doorknob-engaging platform for vertical sliding movement and swiveling movement between a first, storage position, and a second, clamping position between the doorknob and the door, to thereby vertically clamp the doorknob-engaging platform to the inner doorknob;

wherein the loop portion of the clamping member has a diameter or width less than the diameter or width of the doorknob.

2. The barricade bar of claim 1 wherein the doorknob-engaging platform is sized and shaped to rest on an upper part of the inner doorknob.

3. The barricade bar of claim 2 wherein the doorknob-engaging platform comprises a vertical portion for axially engaging the inner doorknob to resist the door being pulled open before the clamping member is engaged.

4. The barricade bar of claim 3 wherein the vertical portion of the doorknob-engaging platform comprises a doorknob-shaped recess formed in an underside of the doorknob-engaging platform.

5. The barricade bar of claim 3 wherein the vertical portion of the doorknob-engaging platform comprises a vertical extension that extends downwardly between the inner doorknob and the door.

6. The barricade bar of claim 5 wherein the vertical extension comprises a slot for admitting a stem portion of the doorknob, the vertical extension extending below the doorknob when the doorknob-engaging platform is engaged with the inner doorknob.

7. The barricade bar of claim 1 further comprising locking means for locking the clamping member in the clamped position.

8. The barricade bar of claim 7 wherein the locking means comprises an automatic locking means on the doorknob-engaging platform, the automatic locking means activated by movement of the clamping member to lock the clamping member in the clamping position.

9. The barricade bar of claim 8 wherein the automatic locking means comprises means for receiving a remote unlocking signal to unlock the clamping member.

10. The barricade bar of claim 1 wherein the bar directly engages the vertical side of the doorframe when the doorknob-engaging platform rests on the inner doorknob.

11. The barricade bar of claim 1 wherein the bar directly engages a wall surface adjacent the vertical side of a recessed doorframe, and overlies the vertical side of the recessed doorframe.

12. The barricade bar of claim 10 wherein the clamping member has a wedge fit against a back surface of the doorknob in the clamped position.

13. The barricade bar of claim 11 wherein the clamping member has a wedge fit against a back surface of the doorknob in the clamped position.

14. The barricade bar of claim 1 wherein the clamping member is hinged on the doorknob-engaging platform for clamping engagement with the doorknob.

15. A barricade bar for barricading a doorknob-equipped, outwardly-opening door from inside a room without having to open the door or operate a doorknob locking mechanism from the outside of the room, the barricade bar comprising:

a locking bar adapted to extend generally horizontally from an inner doorknob to engage at least one of the vertical sides of a doorframe in a non-rotating manner; and a doorknob clamping mechanism comprising a doorknob-engaging platform extending from the bar to overlie the doorknob when the bar is engaged with the doorframe, the doorknob clamping mechanism further comprising a generally U-shaped clamping member slidably mounted in the doorknob-engaging platform with a loop portion extending below the doorknob-engaging platform, comprising two vertical leg portions slidably trapped in the doorknob-engaging platform, the clamping member being movable between a first, storage position, and a second, clamping position between the doorknob and the door, to thereby vertically clamp the doorknob-engaging platform to the inner doorknob;

wherein the loop portion of the clamping member has a diameter or width greater than the diameter or width of the doorknob.

16. The barricade bar of claim 15 wherein the clamping member is a rigid member.

17. The barricade bar of claim 15 wherein the clamping member is a flexible member.

* * * * *